US006857138B2

(12) United States Patent
Moser et al.

(10) Patent No.: US 6,857,138 B2
(45) Date of Patent: Feb. 22, 2005

(54) ERGONOMIC RAISED TOILET SEAT ASSEMBLY

(76) Inventors: Scott Andrew Moser, 5726 La Jolla Blvd. Suite 104, La Jolla, CA (US) 92037; George Albert Mansfield, 5726 La Jolla Blvd. Suite 104, La Jolla, CA (US) 92037

( * ) Notice: Subject to any disclaimer, the term of this patent is extended or adjusted under 35 U.S.C. 154(b) by 368 days.

(21) Appl. No.: 10/324,695

(22) Filed: Dec. 19, 2002

(65) Prior Publication Data

US 2004/0025234 A1 Feb. 12, 2004

Related U.S. Application Data

(60) Provisional application No. 60/402,129, filed on Aug. 9, 2002.

(51) Int. Cl.[7] ..... A47K 13/26

(52) U.S. Cl. ..... 4/237; 4/254

(58) Field of Search ..... 4/235, 237, 239, 4/240, 254

(56) References Cited

U.S. PATENT DOCUMENTS 3,786,522 A * 1/1974 Kira et al. ..... 4/237
5,412,815 A * 5/1995 Ellis ..... 4/239
5,414,875 A * 5/1995 Kappl et al. ..... 4/240 X
5,708,989 A * 1/1998 Ellis ..... 4/237

* cited by examiner

*Primary Examiner*—Robert M. Fetsuga
(74) *Attorney, Agent, or Firm*—Mobility Inc.

(57) ABSTRACT

An ergonomic raised toilet seat assembly, comprising an ergonomically contoured raised toilet seat, ergonomically shaped armrests, ergonomically shaped secondary grips, ergonomically shaped grip handles, and a quick release system for rapid installation and removal from a toilet.

15 Claims, 14 Drawing Sheets

Section A-A

SECTION A-A

ERGONOMIC RAISED TOILET SEAT ASSEMBLY

CROSS REFERENCE TO RELATED APPLICATIONS

This application claims the benefit of the filing date of provisional application No. 60/402,129 filed on Aug. 9, 2002.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Nor applicable.

BACKGROUND OF THE INVENTION

The present invention relates to a device that assists persons of limited mobility to make use of a toilet by means of ergonomic features that make the toileting process not only more comfortable, but also safer and less physically challenging.

The present invention comprises a thicker and anatomically contoured toilet seat, which locks securely on a conventional toilet; anatomically contoured armrests and grip handles, designed to assist a physically challenged user in approaching, using and leaving the toilet; and a quick connect/disconnect feature, which allows the user or the care provider to remove or install a toilet seat of conventional profile within a short time and with little effort.

Several designs have been disclosed to date, that facilitate toilet use by persons with conditions such as age, arthritis, surgeries (especially hip and knee replacements), strokes, neurological disorders and other medical conditions. Such users are affected by strength and balance dysfunctions, and, in general, by limitations in their ability to walk, to stand, and to get to and away from a toilet. Standard toilet seats may also increase stress on the user's joints and muscles when she attempts to lower onto, or rise from, a toilet.

These existing designs raise the height at which a patient sits on a toilet, and that, in a few instances, also include a frame to facilitate the sitting and standing movements. However, none of these designs address the ergonomic requirements of raised toilet seats, both of the seat itself, and of the structure supporting the patient. In addition, installation of such devices to increase the height of the toilet seat is sometimes time-consuming and physically challenging, if not impossible for certain groups of users.

U.S. Pat. No. 4,214,323 dated Jul. 29, 1980 by Thomas discloses a raised toilet seat apparatus that is partially inserted into a conventional toilet bowl and that is stabilized by L-shaped flanges attached to sides of such apparatus. A metal frame attached to this apparatus assists in the placement and removal of the apparatus into and from the toilet bowl, and supports the user while approaching and leaving the toilet.

U.S. Pat. Nos. 4,462,122 dated Jul. 31, 1984 by Broeils and 4,477,932 dated Oct. 23, 1984 by Lenoski disclose raised toilet seats that are superimposed over the bowl of a conventional toilet. The conventional toilet seat and cover remain in place but cannot be used until the raised toilet seat is removed. The raised toilet seat is secured to the toilet bowl by a fork-shaped rail that slides between and around the existing seat bolts.

U.S. Pat. No. 4,638,514 dated Jan. 27, 1987 by Landsberger discloses a raised toilet seat that is secured to the toilet bowl by means of an inner ring that extends from the lower surface of the raised seat and that is inserted inside the bowl rim. This invention includes a bidet-like device.

U.S. Pat. No. 5,027,445 dated Jul. 2, 1991 by Locarno discloses a raised toilet seat that is superimposed upon the bowl of a conventional toilet, and that is secured to the toilet bowl by a clamp fitting into the space provided when the lid and the seat of the conventional toilet seat are lifted. Optional support members on such clamp assist the movement of a patient to and from the toilet.

U.S. Pat. No. 5,199,112 dated Apr. 6, 1993 by Locarno discloses a raised toilet seat with a configuration that is designed to support patients with total hip arthroplasty. The seat described in this invention is secured to the toilet bowl by a ring on the underside of the seat that fits inside the ridge of the bowl. The anatomical contour of this seat is substantially different from the present invention due to its dedicated application.

U.S. Pat. No. 5,251,338 dated Oct. 12, 1993 by Light discloses a toilet height conversion device, that essentially consists of a block superimposed on a conventional toilet bowl, and of a pivotally-connected raisable elevator, that increases the height at which a conventional toilet seat and cover can be attached.

U.S. Pat. No. 5,412,812 dated May 9, 1995 by Ellis discloses a raised toilet seat, which essentially consists of a ring superimposed on a conventional toilet bowl and which is secured to the bowl by a clamp that engages the inner side of the bowl ridge.

U.S. Pat. No. 5,708,989 dated Jan. 20, 1998 by Ellis discloses a raised toilet seat assembly that includes extended handles but that is not ergonomically contoured, nor exhibits a device for switching quickly between a raised and a conventional toilet seat.

U.S. Pat. No. 5,920,917 dated Jul. 13, 1999 by Ellis discloses a toilet height conversion structure which includes a mounting block positioned at the rear portion of the toilet and a riser. A support frame is positioned around the toilet and connected to the mounting block.

U.S. Pat. No. 6,052,838 dated Apr. 25, 2000 by Thom et al. discloses a toilet seat aid that supports and raises a conventional toilet seat, and that is connected to the toilet bowl through passing bolts.

U.S. Pat. No. 6,311,341 dated Nov. 6, 2001 by Zwezdaryk discloses a chair for covering a conventional toilet and includes a tank, a hinged seat, a bowl and a flushing handle.

U.S. Pat. No. 6,418,566 dated Jul. 16, 2002 by Plonta discloses a kit for raising a conventional toilet seat, which consists of three lift blocks, a toilet seat mounting lift block, and two elongated bolts and fasteners for the lift blocks.

U.S. Pat. No. 6,438,769 dated Aug. 27, 2002 by Luckenbill discloses a mobile seat lifting apparatus, consisting of a seat assembly that is connected to a frame, an actuator, and a driving mechanism that raises and lowers the seat.

In summary, existing designs do not include ergonomic features that are specifically targeted at users of limited mobility, both in the anatomical contour of the seat and, when available, of the support armrests and handles. Also, the connecting systems that lock the seat to a conventional toilet bowl are sometimes ill suited for a physically challenged user.

In addition, existing designs also do not fully address the needs of a caregiver to have a toilet seating system that makes the user as self-assisting as possible, that avoids the contamination risks of seats being partially inserted within a toilet bowl, and at the same time that can be interchanged with a conventional toilet seat with minimum effort.

BRIEF SUMMARY OF THE INVENTION

The present invention improves on the existing art by including features that conform both to the shape of the human body, in particular, the buttocks, hands and arms, and to the typical movements of users that are elderly, handicapped, or otherwise affected by limited ability to move and grab. The instinctive behavior of elderly or physically challenged patients that are affected by balance and orientation problems is to look for a stable point to grab and to hold on to. This is especially the case in the dark, because toilets are often used during the night, or in situations involving incontinence, where the user not only needs stability and balance, but also quick access to the toilet.

Therefore, it is important for these patients to have a point or a grip handle near the toilet on which to grab and lean. In addition, when moving backwards to sit on the toilet, the instinctive reaction of these patients is to open and to orient their hands perpendicular to the floor, and to approach available grip points with the palms of their hands first and then to wrap their hands around such grip points, pushing downwards and rearwards. The feeling of safety and comfort is increased when the grip points around the toilet seat are ergonomically designed to correspond both to the instinctive movements of the user and to the shape of the human hand, thereby increasing the strength of the grip and the sensorial perception generated by the hand nerves.

The present invention consists of an ergonomic raised toilet seat assembly that comprises an ergonomically-contoured raised toilet seat; ergonomically-contoured, forward-extending grip handles which the user can grab and use for support when approaching and leaving the toilet; ergonomically-contoured secondary grips which serve as alternative grab points for a user when standing from or sitting on the toilet seat, and at the same time as transversal resting surfaces for the user's arms while using the toilet; ergonomically-contoured armrests which serve as lengthwise resting surfaces for the user's arms; an ergonomically-contoured release lever which locks or releases the raised toilet seat from a quick release system; and a quick release systems, comprising a lower bracket attached to the toilet bowl and an upper bracket that is part of the raised toilet seat.

Such quick release system makes the assembly easy to install and to remove from a toilet. Matching blades on the upper bracket, sliding under wings on the lower bracket, affix the raised toilet seat to the toilet bowl, and a pin that is part of the above mentioned release lever securely locks the raised toilet seat to the lower bracket of the quick release system.

The present invention can take different embodiments, for instance, the raised toilet seat can have an "O" or "C" shape, and the grip handles, secondary grips and armrests can be made with different ergonomic profiles or with a fluorescent material that facilitates use during nighttime.

DETAILED DESCRIPTION OF THE INVENTION

The present invention improves on the existing art by fulfilling the need of persons of limited mobility for a toilet seat with an ergonomic shape that facilitates toilet use, and with ergonomic grip handles, secondary grips and armrests that assist the patient during sitting and standing movements and that help supporting the patient during use. The present invention is also designed to maximize user safety due to its sturdy construction, and to allow for a rapid switch-over from, and to, a conventional toilet seat due to its quick release system that not only allows for rapid and effortless installation and removal, but also for a secure connection to the toilet bowl.

The present invention may be embodied in different forms. Therefore, the details described herein are exemplary and not to be understood as limiting, but merely as the basis for teaching one skilled in the art how to make or use the invention.

Figure 1:
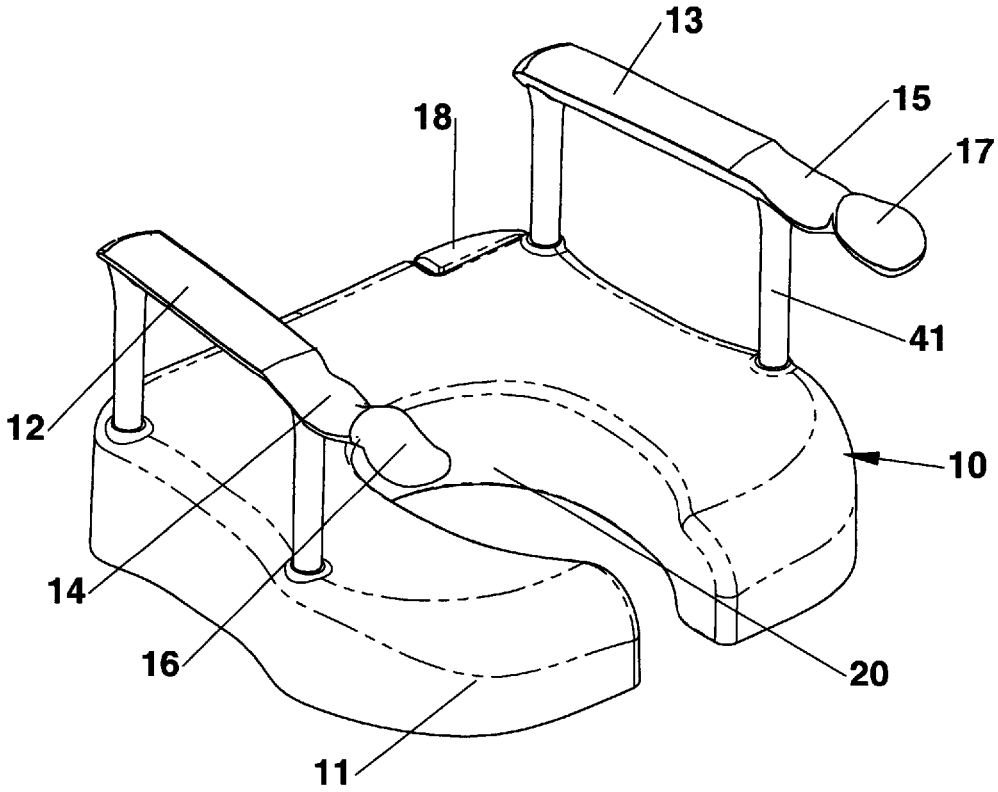
FIG. 1 illustrates the ergonomic raised toilet seat assembly, as seen from the front.
Figure 2:
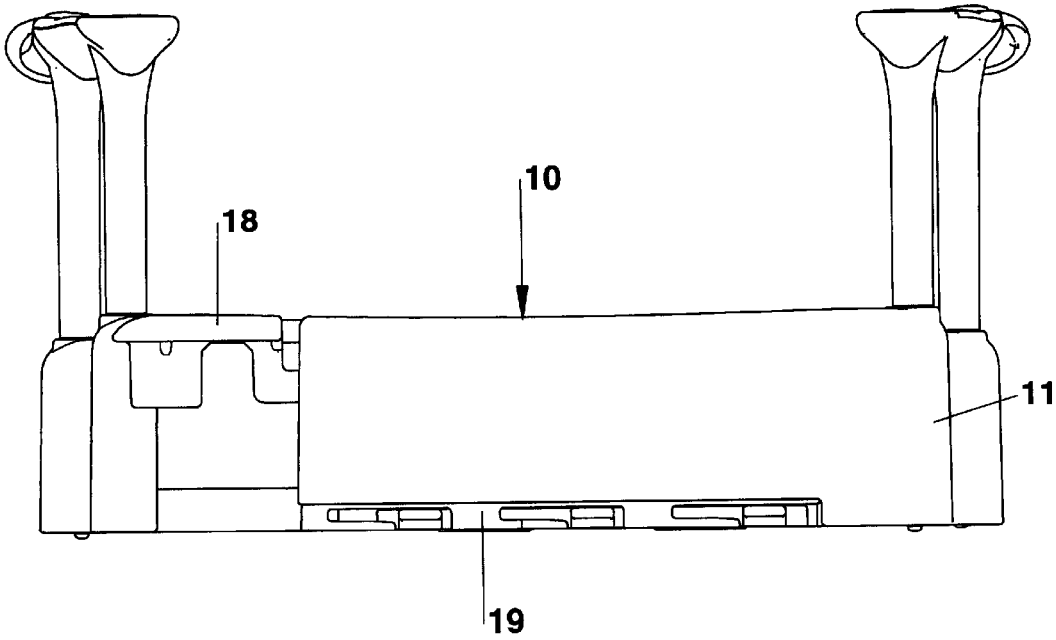
FIG. 2 illustrates the raised toilet seat assembly, as seen from the rear.

With reference to FIGS. 1 and 2, the preferred embodiment of the ergonomic raised toilet seat assembly 10 includes ergonomically shaped raised toilet seat 11, ergonomically profiled armrests 12 and 13, ergonomically profiled secondary grips 14 and 15, ergonomically profiled grip handles 16 and 17, ergonomically profiled release lever 18 to unlock the seat from the toilet bowl, and quick release system 19 to install quickly and attach securely seat 11 to the toilet bowl. The weight of assembly 10 is approximately 3 kilograms, yet it is designed to support the weight of a 140 kilogram user.

Seat 11 is approximately 10 centimeters thick in the front area and 13 centimeters thick in the rear area, and exhibits a contoured surface that accommodates body shape and that at the same time increases buttock separation, in order to improve the toileting experience. Buttock separation is further increased by a mirror finish, which creates a vacuum seal with the human skin, thereby preventing the sliding of the buttocks towards perineal opening 20.

Figure 3:
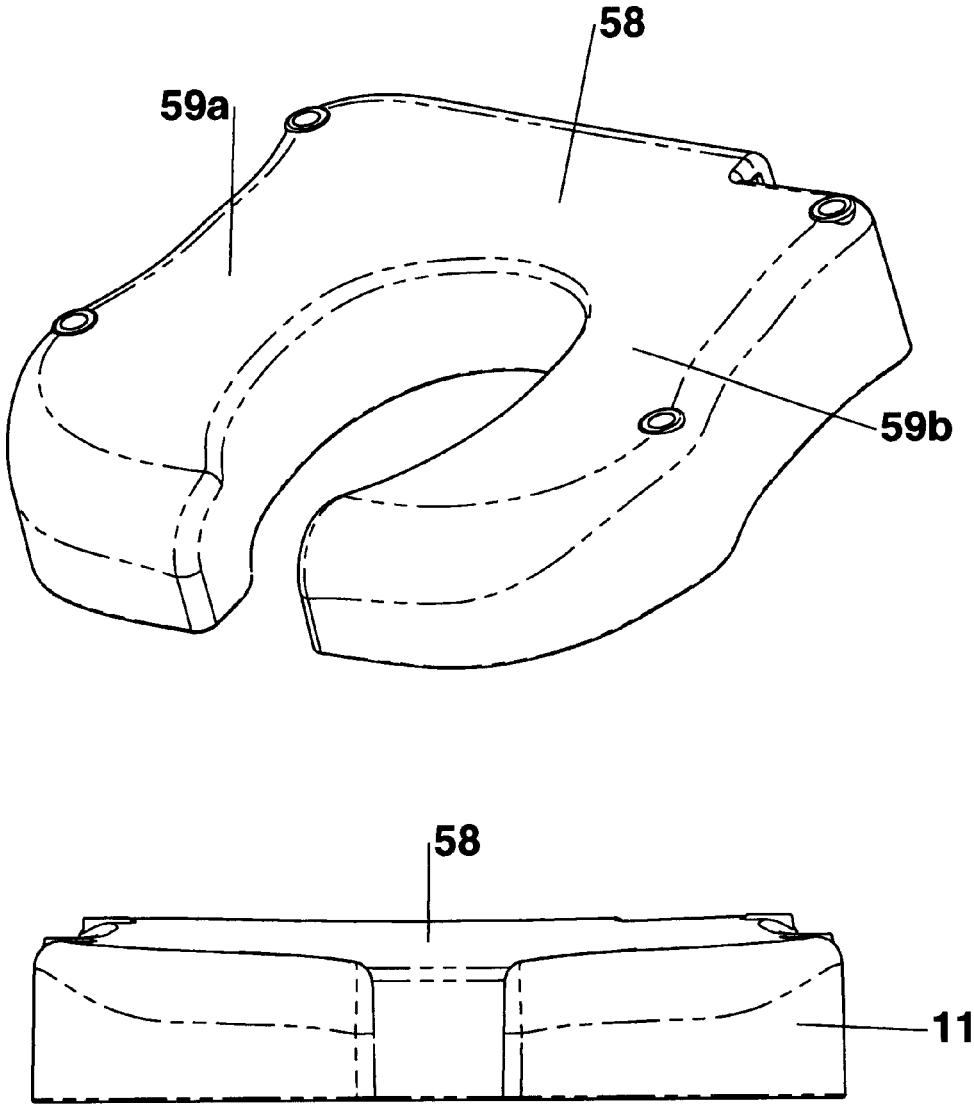
FIG. 3 illustrates two different views of the raised toilet seat.

As shown in FIG. 3, the ergonomic surface of seat 11 slopes downwards from rear to front and from sides to center, not in a linear fashion but with shallow cavities. Specifically, one cavity 58 is situated in the rear portion of the seat and two cavities 59*a* and 59*b* are situated one in each of the side portions of the seat. In the preferred embodiment, such cavities are cylindrical, whereby cavity 58 has a longitudinal axis running from back to front of seat 11 and cavities 59*a* and 59*b* are parallel and have a common longitudinal axis running from left to right of seat 11. In other embodiments, such cavities have different shapes, for instance, concave.

All edges of seat 11 are rounded, including the edges defining perineal opening 20, which are convex. In the preferred embodiment, seat 11 has a C-shaped configuration, which allows the user to access his or her perineal area easily and which facilitates seat cleaning. In a different embodiment, seat 11 has a closed, O-shaped configuration.

Figure 4:
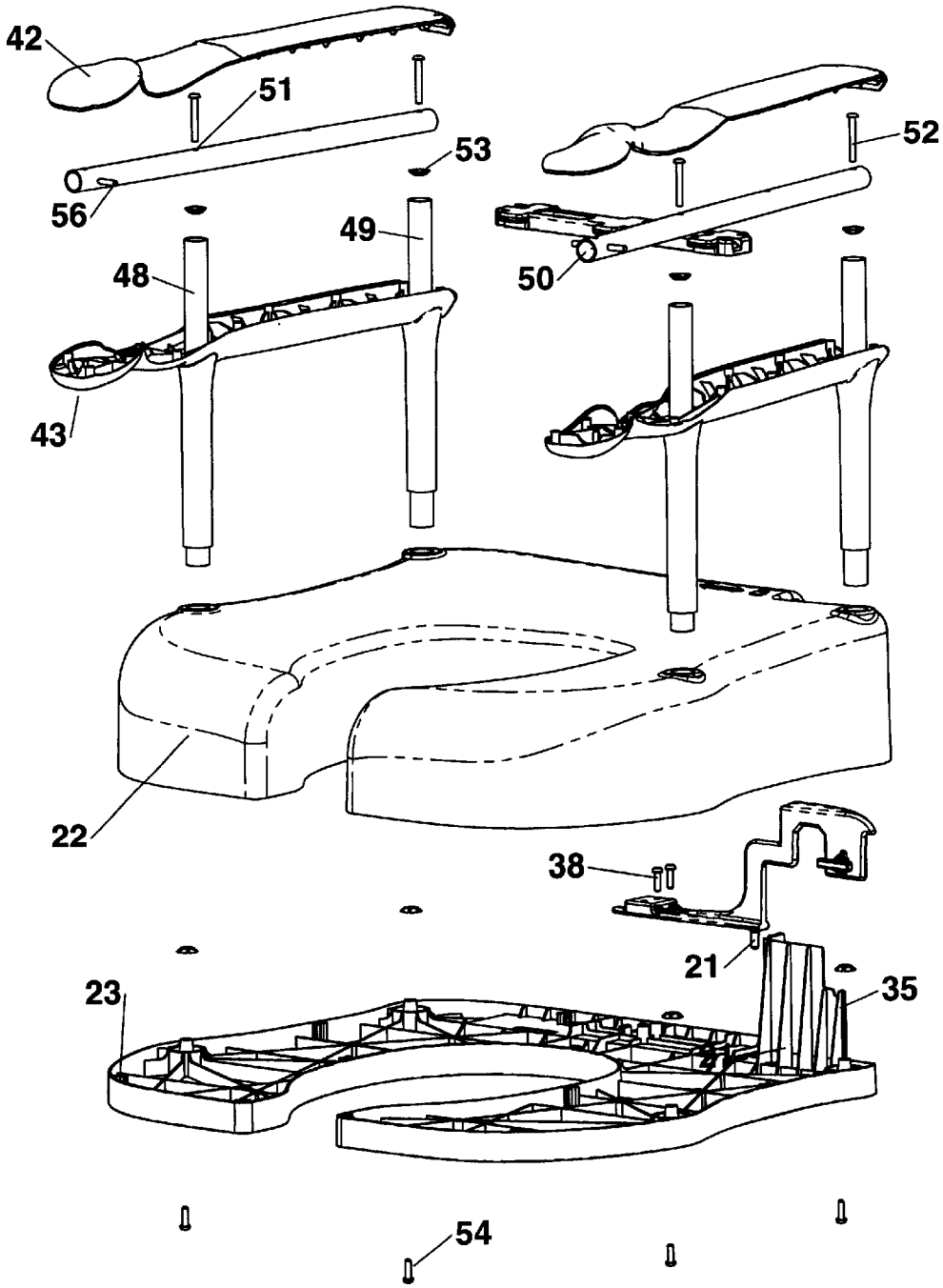
FIG. 4 illustrates the construction features of the raised toilet seat.

Referring further to FIG. 4, seat 11 is composed of base member 21 and seat member 22, which are both hollow and reinforced by a ribbed structure. Such ribbed construction provides seat 11 not only with the static strength required to support a user up to 140 kilograms in weight, but also with the dynamic strength to withstand impact and abuse in a hospital, nursing home or private home environment. Both base member 21 and seat member 22 are manufactured in injection molded plastic, in order to reproduce accurately the desired ergonomic, aesthetic and structural features and to achieve production cycle times more favorable than prior art seats that utilizes rotational molded plastic. Assembly of base member 21 with seat members 22 is performed by mating eleven guide pins positioned along the perimeter of seat member 22 with eleven holes 23 located in corresponding positions on base member 21, and then by securely joining seat member 22 to base member 21 through the effects of pressure and of an adhesive compound that was previously applied in holes 23.

Figure 5:
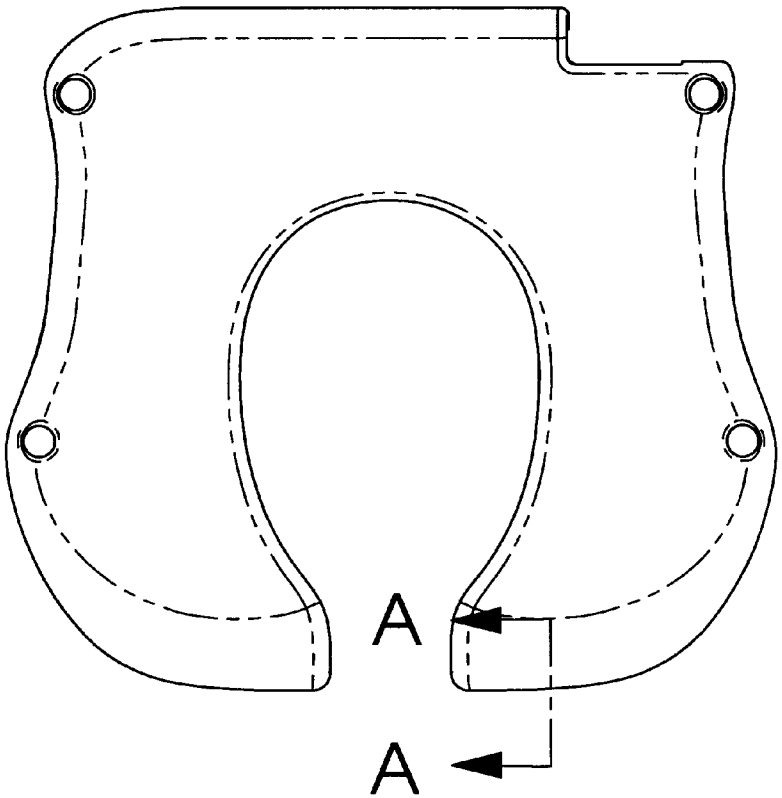
FIG. 5 illustrates a cross-section of the edges of the seat member and of the base member of the raised toilet seat.
Figure 5:
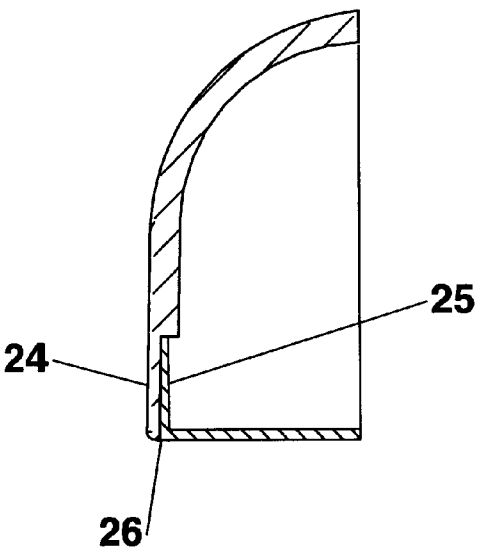

FIG. 5 illustrates a detailed view of the overlapping edges of seat member 22 and base member 21. Downward edge 24 of seat member 22 includes a recessed portion, in which upward edge 25 of base member 21 becomes lodged when seat member 22 and base member 21 are mated. This insures not only a seamless appearance of seat 11, but also that no water meniscus forms at seam 26, improving the periodic cleaning of seat 11 and greatly reducing any undesired retention of dirt.

Figure 6:
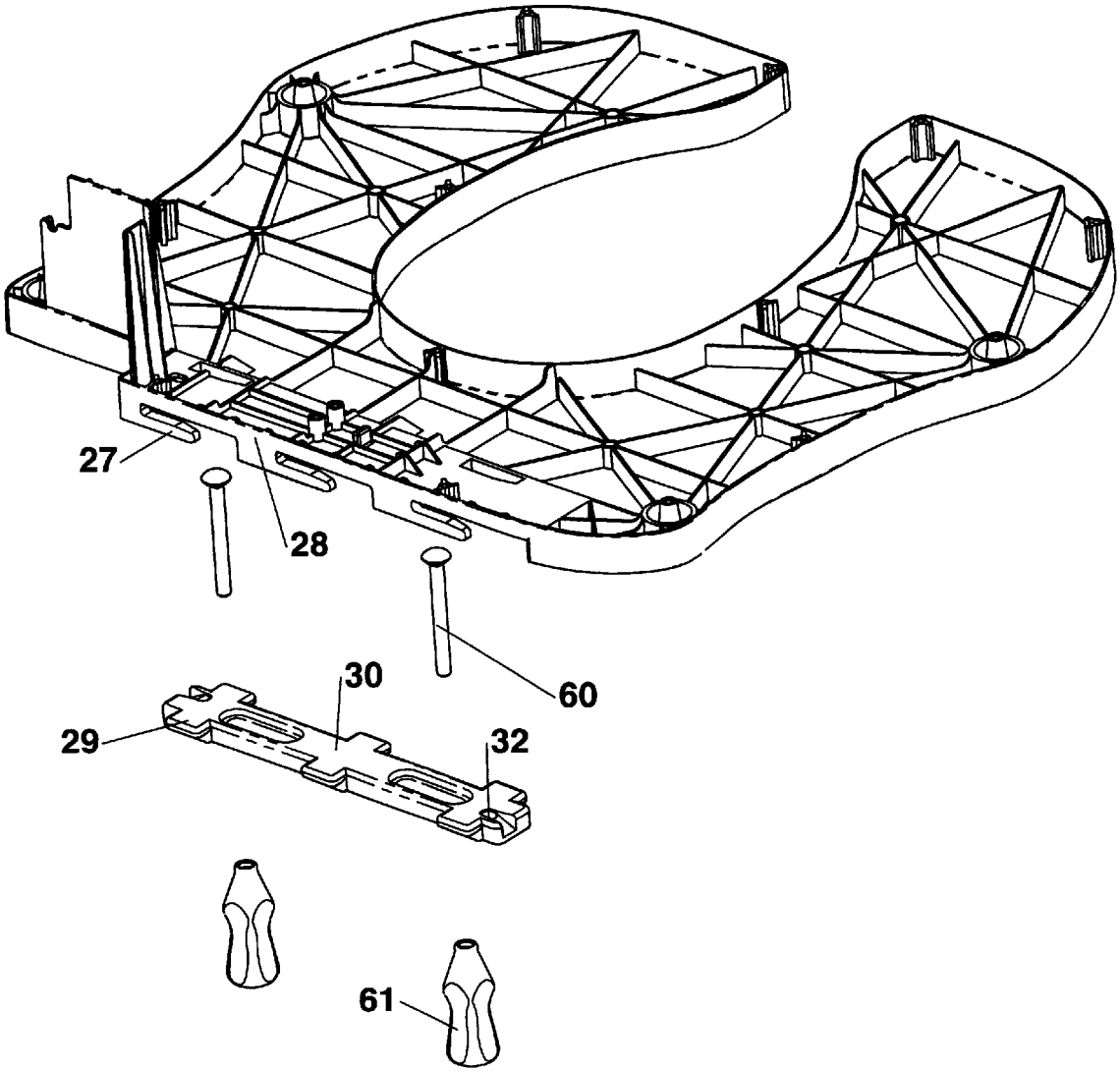
FIG. 6 illustrates an exploded view of the quick release system.

Seat assembly 10 is affixed to a conventional toilet bowl by utilizing quick release system 19, shown in FIG. 6 and disclosed in Applicant Moser's U.S. Pat. No. 6,449,783 dated Sep. 17, 2002, which is incorporated herein by reference. Quick release system 19 allows for a rapid installation and removal of seat assembly 10 from a conventional toilet bowl. Lower bracket 30 is affixed to a toilet bowl by utilizing toilet bolts 60 and toilet nuts 61. Blades 27 on upper bracket 28 slide under wings 29 of lower bracket 30 and seat 11 becomes then locked in place when pin 31, which protrudes from release lever 18, slides into hole 32 of bracket 30. These features provide stability to seat 11, because quick release system 19 not only produces a secure attachment to the toilet bowl but also prevents rocking and sliding motions that are both uncomfortable to the user and inherently dangerous for persons of limited mobility.

Figure 7:
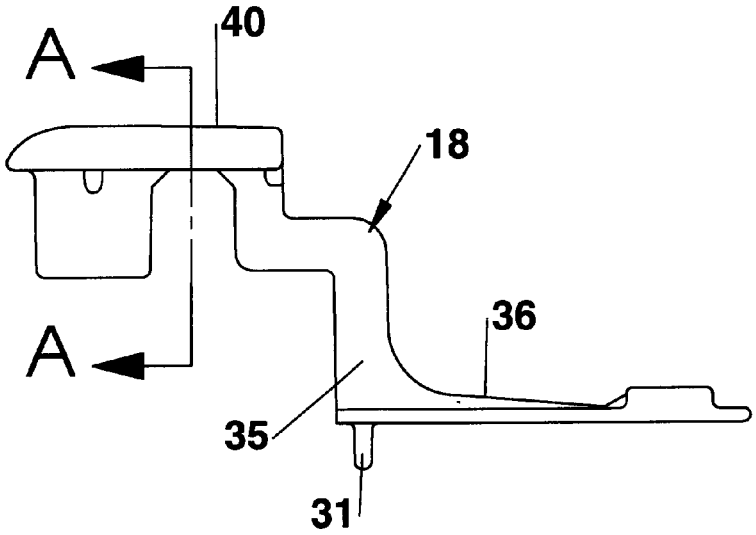
FIG. 7 illustrates the release lever and a cross-section of the handle portion of the release lever.
Figure 7:
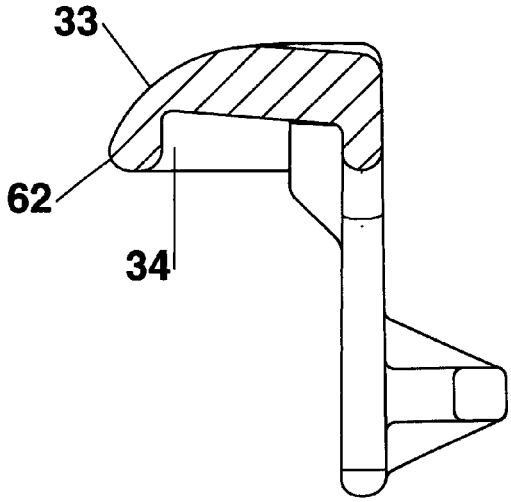

Release lever 18 facilitates an easy and rapid removal of seat 11 from the toilet bowl and is ergonomically designed to assist a patient of limited strength or dexterity. With further reference to FIG. 7, handle portion 40 of release lever 18 exhibits upper surface 33 that is convex and of a size approximately as wide as a human hand, and lower surface 34 that is concave and with rounded edge 62, so that a human hand can easily wrap around upper surface 33, with the fingers flowing over lower surface 34. Release lever 18 is made of plastic material and end portion 36 bends when lifted with a force as low as 5 Newton to unseat pin 31, yet pin 31 can withstand a 500 Newton lateral shear force if lateral pressure is applied on seat assembly 10. Once release lever 18 is lifted, because of quick release system 19, only a 10 Newton force and a 5 centimeter displacement are required to push and slide seat 11 along lower bracket 30 off its engaged position, making quick release system 19 particularly suitable for use in environments of limited space and by persons of limited strength.

Full removal of assembly 10 from the toilet bowl may be accomplished with one arm only, by having a user or a care provider slide her arm under armrest 13, then unlock raised seat 11 from lower bracket 30 by lifting release lever 18, and, by pulling with the same arm on armrest column 41 and then lifting, remove and then carry away seat assembly 10 from the toilet bowl. Because raised toilet seat assembly 10 can be removed with one arm only, the user or provider can use her other arm to assist herself or the patient. This feature is particularly important for users that do not have use of both arms, or to assist handicapped users.

Once seat 11 is removed, a conventional toilet seat that incorporates the same quick release system 19 and that is known as guest seat, can be installed if use of raised seat assembly 10 is not necessary.

When in its rest position, upper surface 33 of handle portion 40 of release lever 18 is flush with the contoured surface of seat 11 and is supported by vertical wall 35, which protrudes from, and is an integral part of, base member 21. End portion 36 of lever 18 instead is supported by ribs 37 on base member 21, and is attached to base member 21 through two parallel screws 38 that are inserted in downward holes 39. Thus, end portion 36 of lever 18 is held attached to base member 21 and seat member 22 by screws 38 when handle portion 40 is raised.

Figure 8:
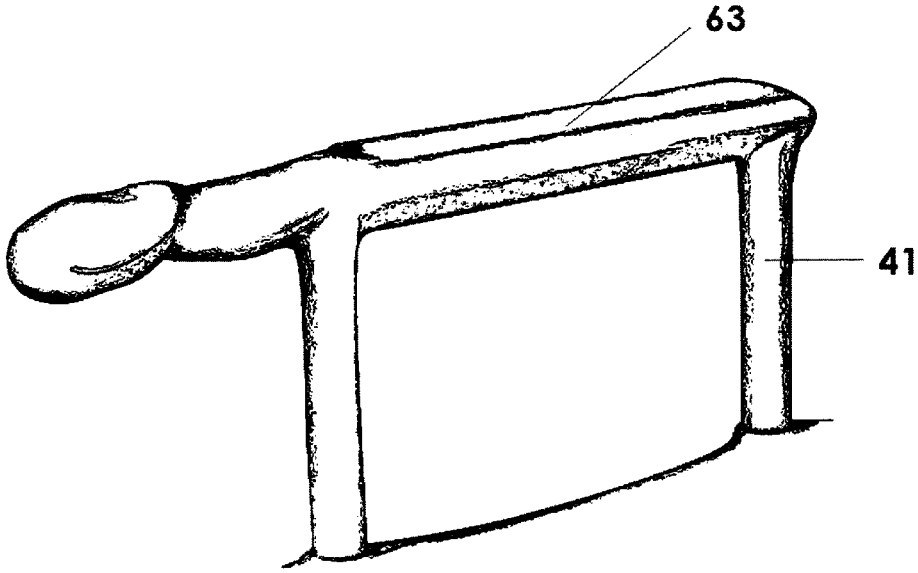
FIG. 8 illustrates the ergonomic shapes of the armrest, secondary grip and grip handles.

Armrests 12 and 13 are each attached to the seat 11 through two armrest columns 41 and are designed to provide the user with comfort and stability while using the toilet. With further reference to FIG. 8, the upper surfaces of armrests 12 and 13 have trough-like shapes 63 to accommodate the user's arms. In different embodiments, armrests 12 and 13 are each supported by a single column, and may also include means for adjusting the height of armrests 12 and 13.

Figure 9:
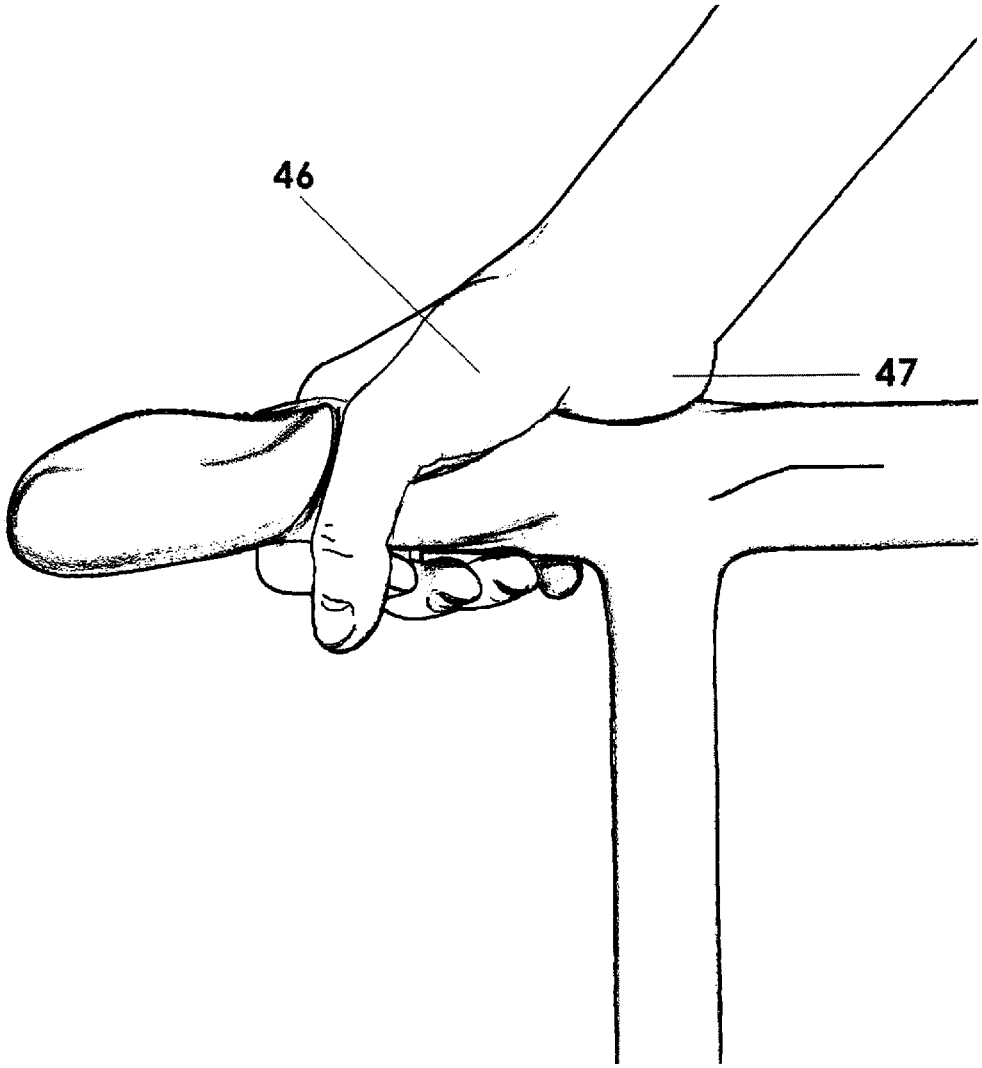
FIG. 9 illustrates the position of a human hand on a secondary grip.

Secondary grips 14 and 15 extend forward from the front end of armrests 12 and 13, and are designed to provide a grip point for the user when she stands up from the toilet or lowers down on the toilet; in addition, secondary grips 14 and 15 provide convenient rest points for the forearms of the patient if she slouches forward during toilet use. As shown in FIG. 9, the profiles of secondary grips 14 and 15 are ergonomically designed to match the contours of the palms of a human hand when grabbing a tubular object and pushing downwards and backwards. In that position, the palmar arch of a human hand, aa well as radial portion 46 and ulnar portion 47, have appropriate rest points, and pressure on the median nerve and on tendon of palmaris longus is relieved, thereby reducing user discomfort.

Figure 10:
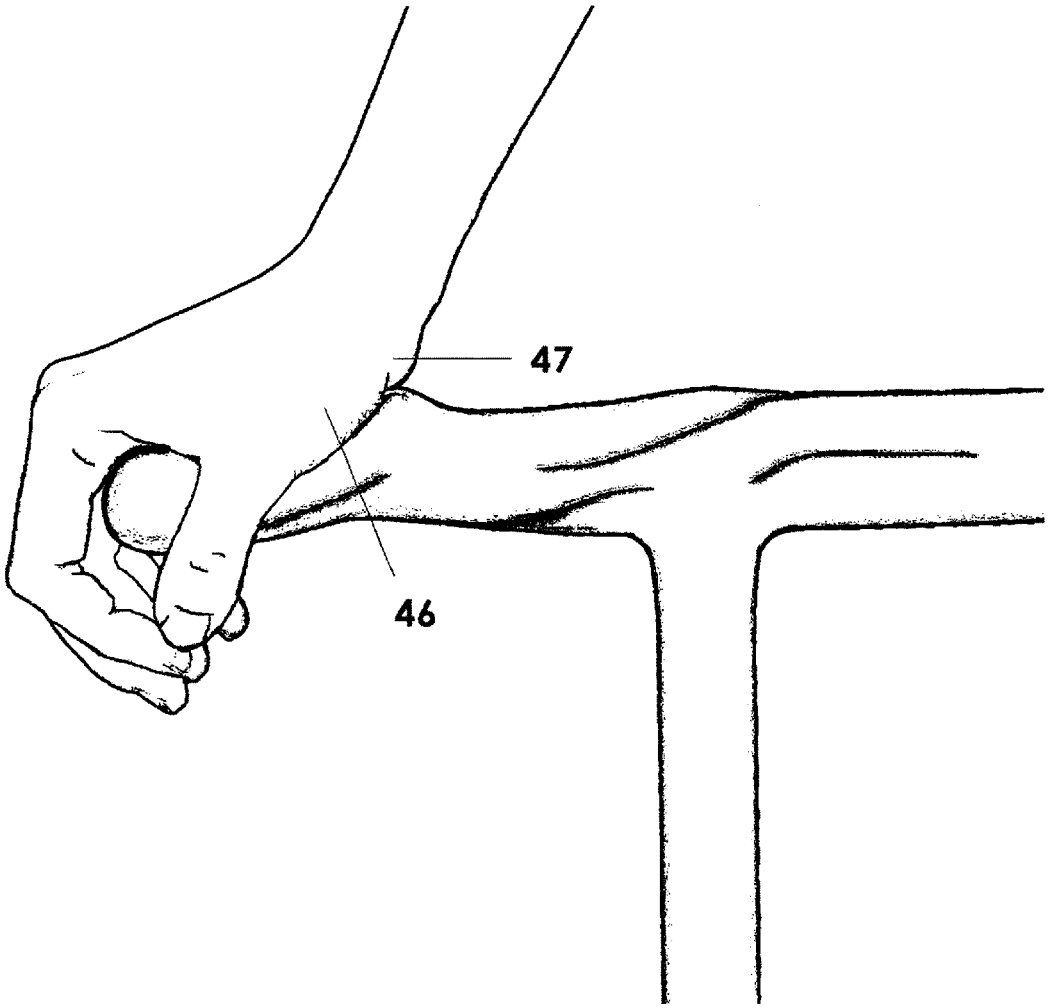
FIG. 10 illustrates the position of a human hand on a grip handle.

Grip handles 16 and 17 are ergonomically designed to assist the user during the sitting and standing motions. In the preferred embodiment, grip handles 16 and 17 match the shapes of the palms of a human hand when grabbing a spherical object and pushing downwards and backwards. As shown in FIG. 10, the palmar arch of a human hand, as well as radial portion 46 and ulnar portion 47, have appropriate rest points, and pressure on the median nerve and in the tendon of palmaris longus is relieved.

Such ergonomic shapes make grip handles 16 and 17 easy to grab by a user when she is about to sit, and are of special relevance for users with hand impairments, such as arthritic and finger-mutilated patients, during sitting and standing, because such users can wrap their palms around grip handles 16 and 17, thereby gripping grip handles 16 and 17 with their palms rather than with their fingers.

Grip handles 16 and 17 extend forward for the full length of seat 11, providing a more comfortable grip point than in earlier inventions, which includes instead more rearward positioned grip points.

Figure 11:
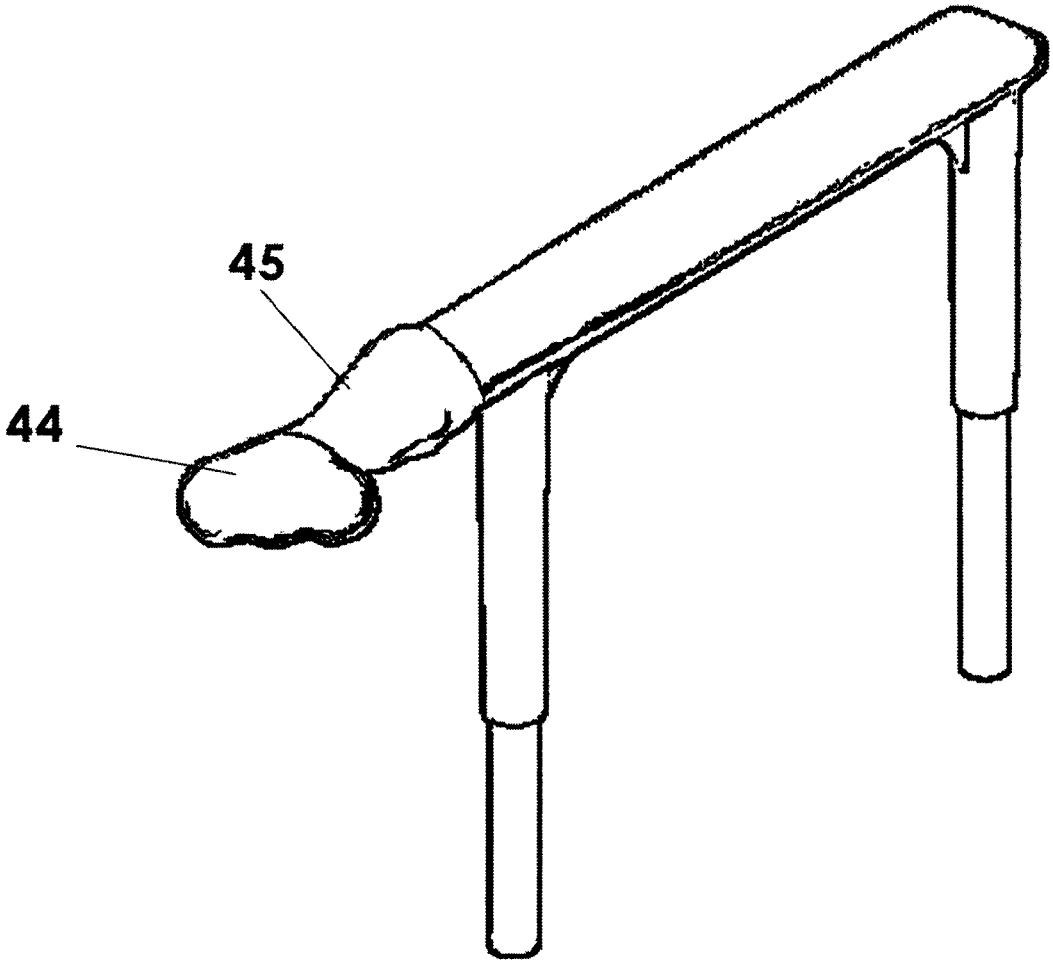
FIG. 11 illustrates one alternative embodiment of the secondary grip and of the grip handle.
Figure 12:
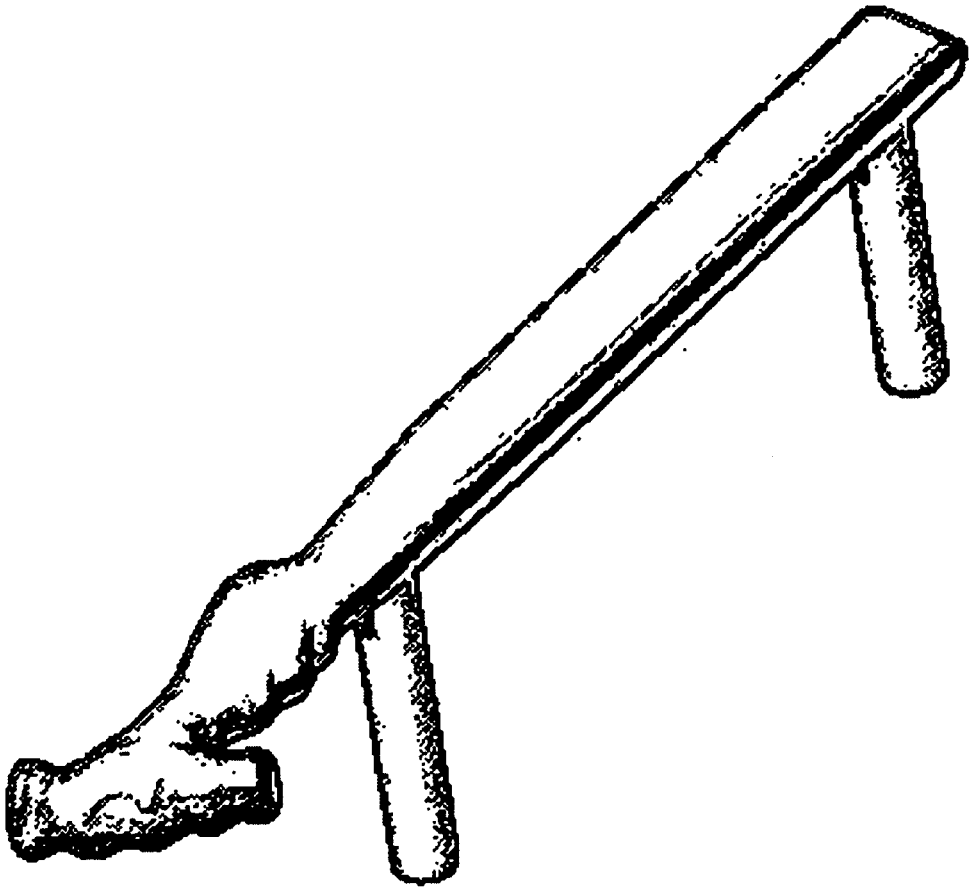
FIG. 12 illustrates another alternative embodiment of the secondary grip and of the grip handle.

In different embodiments, grip handles 16 and 17 have different configurations, ranging from spherical to various ergonomic shapes, and secondary grips 14 and 15 may also exhibit various configurations. FIG. 11 illustrates one such different embodiment. Grip handle 44 resembles the shape of a closed fist, including impressions where the user's palms and fingers are positioned, and secondary grip 45 also includes impressions that serve as rest points for the user's palms and fingers. FIG. 12 illustrates another such different embodiment.

Figure 13:
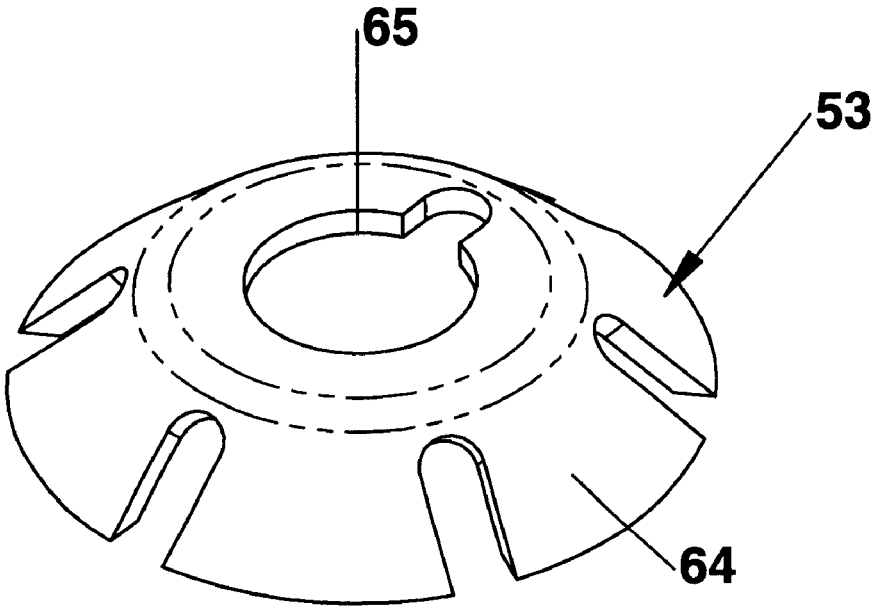
FIG. 13 illustrates a spring retention washer.

In the preferred embodiment, armrests 12 and 13 have pipes as backbones. Specifically, as shown in FIG. 4, vertical pipes 48 and 49 connect to horizontal pipe 50, which carries pre-drilled holes 51 to accommodate fastening screws 52. Spring retention washers 53 are positioned within both ends of pipe 48 and within both ends of pipe 49. The shape of each spring retention washer 53 is convex, as shown in FIG. 13, and resembles an upside-down bowl, with the sides consisting of six flaps 64 that are connected together at the center of spring retention washer 53, and with the center of spring retention washer 53 exhibiting hole 65 in the middle for the passage of pipe bolt 52 or seat bolt 54. Pipe 50 is attached to one end of pipes 48 and 49 through pipe bolts 52, and the opposite ends of pipes 48 and 49 are then inserted into holes 55 on seat 11 and fastened to seat 11 through seat bolts 54 that penetrate through base member 21. Because washers 53 are larger in diameter than the inside diameters of pipes 48 and 49, the flaps of washers 53 bend upon contact with the inner walls of pipes 48 and 49, exerting pressure on the inner walls of pipes 48 and 49 and thereby preventing the assembly from coming apart, either by accident or by a force up to 900 Newton.

The front portion of pipe 50, corresponding to grip handles 16 and 17, is further reinforced by metal rod 56 which is inserted across the front portion of pipe 50. Rod 56 provides outer grip handles 16 and 17 with greater torsional rigidity, which is particularly useful for severely overweight users.

The assembly of vertical pipes 48 and 49 and of horizontal pipe 50 is covered with moldings 42 and 43 that provide the final configuration of armrests 12 and 13, of secondary grips 14 and 15 and of grip handles 16 and 17. Moldings 42 and 43 are made of a synthetic material such as ABS, polypropylene, polyurethane or rubber and are adhesively bonded to the assembly of pipes 48, 49 and 50 in order to prevent any exposed screws on armrests, secondary grips and grip handles. In a different embodiment, moldings 42 and 43 are made of a fluorescent plastic, to improve visibility for the user in a dark environment.

In another different embodiment, seat 11 may be employed with one armrest only, either armrest 12 or armrest 13, rather than two armrests, in order to accommodate space limitations in the user's bathroom or because the user may find one armrest unnecessary, either for better access to the toilet or due to amputation.

Figure 14:
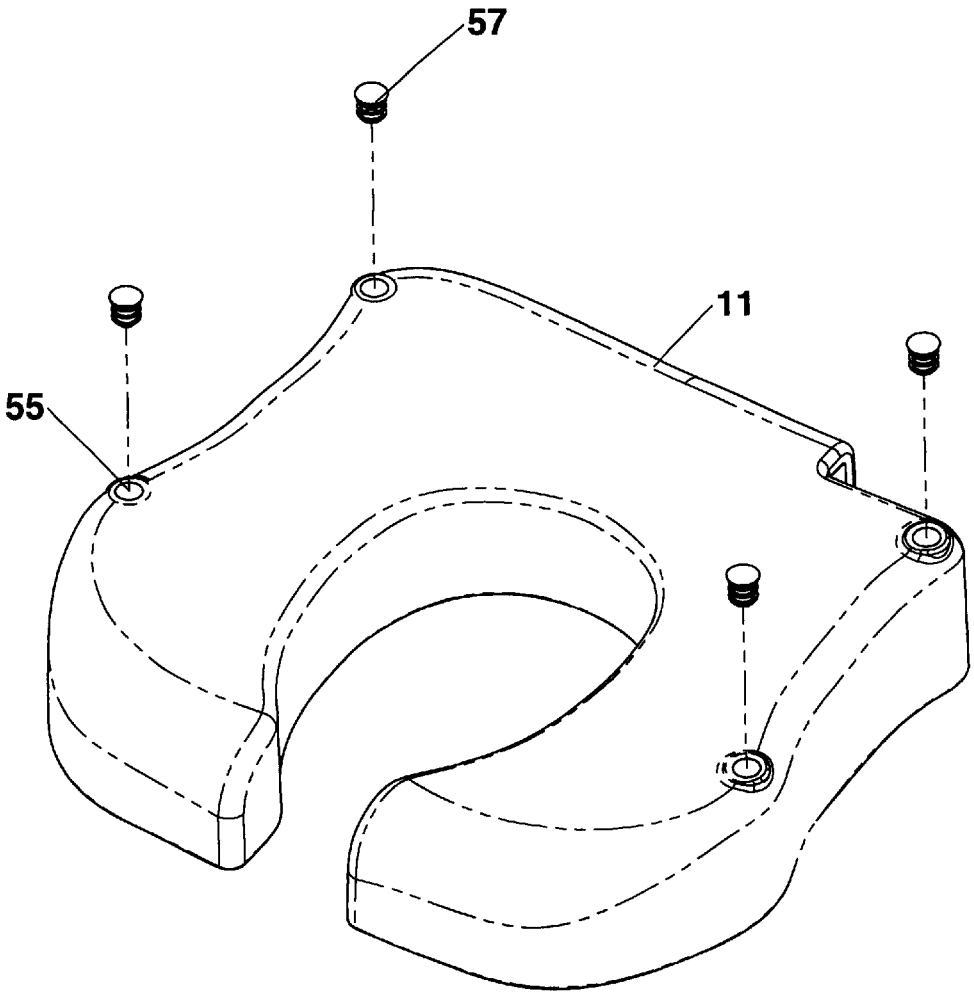
FIG. 14 illustrates an alternative embodiment of the raised toilet seat assembly, limited to the raised toilet seat with plugs closing the holes where the armrest columns are inserted in the preferred embodiment.

In still another different embodiment, seat 11 may be used without armrests 12 and 13. As shown in FIG. 14, in this embodiment, four plugs 57 are inserted into, and close, the four holes 55, providing seat 11 with a basically flush contoured surface.

It is understood that the embodiments herein described do not limit the invention to such disclosures, but, rather, that the present disclosure is intended to cover all modifications and alternate constructions falling within the spirit and scope of the invention as defined in the appended claims.

We claim:

1. An ergonomic raised toilet seat assembly comprising:

An ergonomic raised toilet seat with an ergonomically shaped top surface that increases user comfort and separation of user buttocks and a perineal opening, said top surface being sloped downwards from the rear portion to the front portion and from the side portions to said perineal opening, said top surface also including shallow cavities in said rear portion and in each of said side portions and a convex edge around said perineal opening;

A release lever lodged in a recess of said rear portion of said raised toilet seat, said release lever having a handle portion and an end portion, whereby a pin protrudes from the lower surface of said end portion and disconnects, when said handle portion is pulled upwards, said raised toilet seat from a toilet bowl;

A quick release system affixing said raised toilet seat to said toilet bowl, comprising a lower bracket and an upper bracket, said lower bracket being attached to said toilet bowl by mounting bolts, and said upper bracket being attached to said raised toilet seat, said upper bracket having protruding blades that slide under wings extending from said lower bracket and said upper bracket becoming locked to said lower bracket when said pin on said release lever meets and slides into a matching hole in said lower bracket.

2. An ergonomic raised toilet seat assembly comprising:

An ergonomic raised toilet seat with an ergonomically shaped top surface that increases user comfort and separation of user buttocks and a perineal opening, said top surface being sloped downwards from the rear portion to the front portion and from the side portions to said perineal opening, said top surface also including shallow cavities in said rear portion and in each of said side portions and a convex edge around said perineal opening;

A release lever lodged in a recess of said rear portion of said raised toilet seat, said release lever having a handle portion and an end portion, whereby a pin protrudes from the lower surface of said end portion and disconnects, when said handle portion is pulled upwards, said raised toilet seat from a toilet bowl;

A quick release system affixing said raised toilet seat to said toilet bowl, comprising a lower bracket and an upper bracket, said lower bracket being attached to said toilet bowl by mounting bolts, and said upper bracket being attached to said raised toilet seat, said upper bracket having protruding blades that slide under wings extending from said lower bracket and said upper bracket becoming locked to said lower bracket when said pin on said release lever meets and slides into a matching hole in said lower bracket;

One ergonomically profiled armrest, whereby said armrest is positioned on one side of said raised toilet seat assembly, said armrest being supported by columns inserted into, and securely fastened to, said raised toilet seat, said armrest exhibiting a trough-shaped upper surface;

One ergonomically profiled secondary grip, whereby said secondary grip extends from said armrest and has an outer contour matching the shape of the right or left palm of a human hand when grabbing a tubular object and pushing downwards and backwards;

One ergonomically profiled grip handle, whereby said grip handle extends from said secondary grip and has an outer contour matching the shape of the right or left palm of a human hand when grabbing a spherical object and pushing downwards and backwards.

3. An ergonomic raised toilet seat assembly comprising:

An ergonomic raised toilet seat with an ergonomically shaped top surface that increases user comfort and separation of user buttocks and a perineal opening, said top surface being sloped downwards from the rear portion to the front portion and from the side portions to said perineal opening, said top surface also including shallow cavities in said rear portion and in each of said side portions and a convex edge around said perineal opening;

A release lever lodged in a recess of said rear portion of said raised toilet seat, said release lever having a handle portion and an end portion, whereby a pin protrudes from the lower surface of said end portion and disconnects said raised toilet seat from a toilet bowl when said handle portion is pulled upwards;

A quick release system affixing said raised toilet seat to said toilet bowl, comprising a lower bracket and an upper bracket, said lower bracket being attached to said toilet bowl by mounting bolts, and said upper bracket being attached to said raised toilet seat, said upper bracket having protruding blades that slide under wings extending from said lower bracket and said upper bracket becoming locked to said lower bracket when said pin on said release lever meets and slides into a matching hole in said lower bracket;

Two ergonomically profiled armrests, whereby one of said armrests is positioned on one side of said raised toilet seat assembly and the other one of said armrests is positioned on the opposite side of said raised toilet seat assembly, said armrests being supported by columns inserted into, and securely fastened to, said raised toilet seat, said armrests exhibiting trough-shaped upper surfaces;

Two ergonomically profiled secondary grips, whereby one of said secondary grips extends from one of said armrests and has an outer contour matching the shape of the right palm of a human hand when grabbing a tubular object and pushing downwards and backwards, and whereby the other one of said secondary grips extends from the other one of said armrests and has an outer contour matching the shape of the left palm of a human hand when grabbing a tubular object and pushing downwards and backwards;

Two ergonomically profiled grip handles, whereby one of said grip handles extends from one of said secondary grips and has an outer contour matching the shape of the right palm of a human hand when grabbing a spherical object and pushing downwards and backwards, and whereby the other one of said grip handles extends from the other one of said secondary grips and has an outer contour matching the shape of the left palm of a human hand when grabbing a spherical object and pushing downwards and backwards.

4. The ergonomic raised toilet seat assembly of claim 3, where the ergonomic raised toilet seat and the perineal opening have an oval shapes.

5. The ergonomic raised toilet seat assembly of claim 3, where the ergonomic raised toilet seat and the perineal opening have a "C" shapes defined by an opening in the front portion of the raised toilet seat.

6. The ergonomic raised toilet seat assembly of claim 3, where the raised toilet seat is manufactured from injection molded plastic.

7. The ergonomic raised toilet seat assembly of claim 3, where the raised toilet seat consists essentially of a base member with upward extending vertical edges and a seat member with downward extending vertical edges and where said downward extending vertical edges completely overlap said upward extending vertical edges.

8. The ergonomic raised toilet seat assembly of claim 3, where the columns supporting the ergonomically profiled armrests include means for adjusting the height of said ergonomically profiled armrests from the raised toilet seat.

9. The ergonomic raised toilet seat assembly of claim 3, where the release lever is ergonomically profiled and includes a handle portion with an upper surface exhibiting a convex curvature and a lower surface exhibiting a concave curvature and rounded edges.

10. The ergonomic raised toilet seat assembly of claim 3, where one of the ergonomically profiled secondary grips has an outer contour matching the shape of the right palm and fingers of a human hand when grabbing a tubular object and pushing downwards and backwards, and where the other one of said ergonomically profiled secondary has an outer contour matching the shape of the left palm and fingers of a human hand when grabbing a tubular object and pushing downwards and backwards.

11. The ergonomic raised toilet seat assembly of claim 3, where one of the ergonomically profiled grip handles has an outer contour matching the shape of the right palm and fingers of a human hand when grabbing a spherical object and pushing downwards and backwards, and whereby the other one of said ergonomically profiled grip handles has an outer contour matching the shape of the left palm and fingers of a human hand when grabbing a spherical object and pushing downwards and backwards.

12. The ergonomic raised toilet seat assembly of claim 3, where the armrests, columns, secondary grips and grip handles consist of metal tube cores covered with ergonomically contoured plastic surfaces.

13. The ergonomic raised toilet seat assembly of claim 3, where the armrests, columns, secondary grips and grip handles consist of metal tube cores covered with ergonomically contoured rubber surfaces.

14. The grip handles of claims 12 or 13, where the metal tube core includes a rod connected and perpendicular to said metal tube core in the area corresponding to the grip handles, in order to increase the torsional rigidity of said grip handles.

15. The grip handles of claim 13, where the armrests, columns, secondary grips and grip handles consist of metal tube cores covered with ergonomically contoured fluorescent plastic surfaces.

* * * * *